US006902406B1

(12) United States Patent
Kraus

(10) Patent No.: US 6,902,406 B1
(45) Date of Patent: Jun. 7, 2005

(54) CABLE PLUG CONNECTOR

(76) Inventor: Peter B. Kraus, 18115 NE. 92nd Ave., Battle Ground, WA (US) 98604

( * ) Notice: Subject to any disclaimer, the term of this patent is extended or adjusted under 35 U.S.C. 154(b) by 0 days.

(21) Appl. No.: 10/712,651

(22) Filed: Nov. 12, 2003

(51) Int. Cl.[7] ..... H01R 39/00
(52) U.S. Cl. ..... 439/11; 439/638; 439/676
(58) Field of Search ..... 439/638, 676, 439/11–30; 379/442

(56) References Cited

U.S. PATENT DOCUMENTS 4,241,974 A * 12/1980 Hardesty ..... 439/638
4,295,702 A * 10/1981 Snyder ..... 439/425
4,362,905 A * 12/1982 Ismail ..... 379/442
4,472,010 A * 9/1984 Parnello ..... 439/14
4,857,013 A 8/1989 Peters
4,865,561 A * 9/1989 Collier et al. ..... 439/391
5,425,172 A * 6/1995 Carswell et al. ..... 29/884
D375,291 S 11/1996 Cheung
5,666,408 A * 9/1997 Lao ..... 379/442
5,697,815 A * 12/1997 Drewnicki ..... 439/638
6,116,958 A * 9/2000 Reichle ..... 439/640
6,139,332 A * 10/2000 Tsai ..... 439/21
6,273,735 B1 * 8/2001 Johnson et al. ..... 439/131
6,340,313 B1 * 1/2002 Hwang ..... 439/638
6,561,852 B2 * 5/2003 Lo ..... 439/638

* cited by examiner

*Primary Examiner*—Gary Paumen
(74) *Attorney, Agent, or Firm*—Kurt M. Rylander

(57) ABSTRACT

An cable plug connector to connect one or more standard telephone or computer cable plugs into wall outlets of the same type at an angle, so that the devices' plugs and cables are protected from damage, including a housing, a cable plug adapter to be connected to a wall socket, attached to the housing at an angle, and a cable jack in said housing, the cable jack being electrically connected to the cable plug adapter. A method for protecting multiple cable plugs from damage, including steps for inserting a plurality of cable plugs into a housing containing multiple cable jacks arranged side-by-side, orienting said housing such that it is perpendicular to, and attached to, a single cable plug adapter, and electrically connecting said cable jacks to said cable plug adapter.

4 Claims, 4 Drawing Sheets

Fig. 10
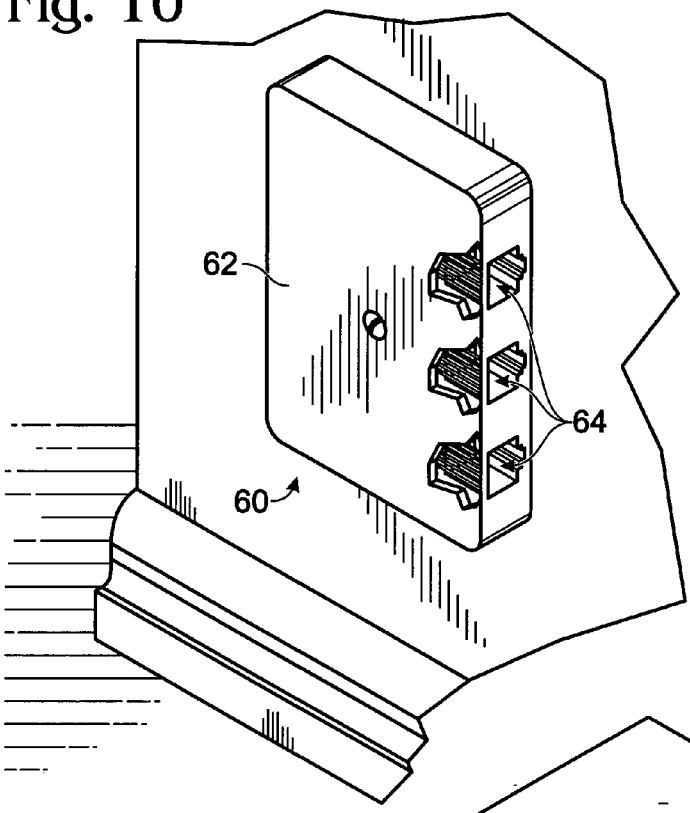
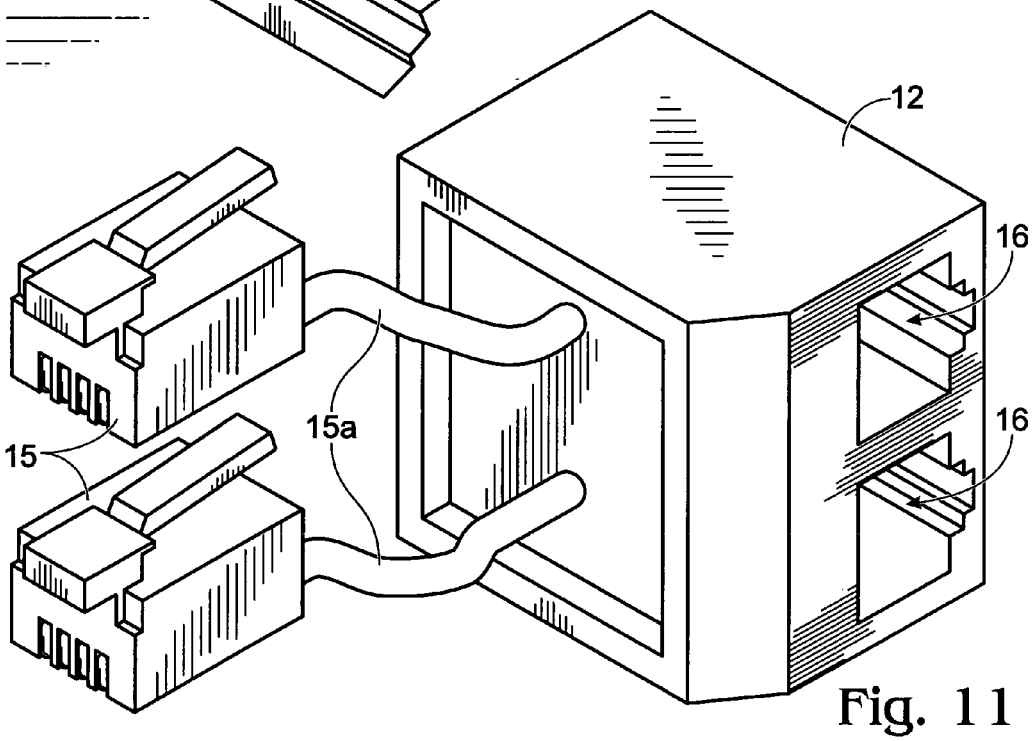
Fig. 11

CABLE PLUG CONNECTOR

FIELD OF THE INVENTION

The subject invention relates generally to the wall outlet plugs, and more particular, to the attachment of a telephone or computer cable plugs into wall outlets of the same type.

BACKGROUND

The standard telephone plug in the U.S. typically referred to as an "RJ-11" plug, plugs directly into a receiving wall jack, also called a "socket," that matches its size and shape. This is also commonly done with computer networking cables, such as ethernet cables, which use a standard plug called the "RJ-45," which is similar in shape and function to the RJ-11 plug, but slightly larger.

FIG. 1 shows an RJ-11 jack, viewed looking into the socket. This jack is of a standard size and shape worldwide, made to receive an RJ-11 plug. The jack accommodates six wire connectors 40, toward the top of the socket, used to transmit data and/or voice communication. Although not important for the invention, in typical use, the RJ-11 uses only the central four or two of these connectors. The RJ-11 standard telephone plug is used in the figures and description for ease of understanding. This should not imply that the invention is limited to any one type of standard plug. The cable plug connector of the present invention can be constructed to accommodate and utilize any standard telephone or networking plug, such as the common RJ-11, RJ-12, and RJ-45 plugs. FIG. 2 shows an RJ-11 plug, with wire connectors 40 on the bottom of the plug, ready for insertion into a jack. The plug has a clip 42 that holds the plug in the jack once inserted. It is manually operated by pressing on an arm 44 connected to the clip, while pulling the plug out of the jack.

In the standard configuration of these attachments, the plug of the telephone cable or networking cable is attached to the wall jack, perpendicular to the surface of the wall, much like a standard two or three-pronged electrical plug and socket. This leaves the plug and its attached cable at risk for damage from furniture or other causes, such as jarring by people or pets.

This problem has been solved in the field of electrical plugs, by reshaping the plug, such that the cable protrudes from the side of the plug, parallel to the wall, rather than perpendicular to the wall. Thus, the electrical wire inside the plug, or the prongs of the plug itself, bend at a ninety-degree angle from where the prongs are inserted into the wall socket. This type of electrical plug is commonly commercially available and widely used. An example of this configuration is represented in U.S. Pat. No. 4,857,013 to Peters. Similarly, U.S. Design Patent D375,291 to Cheung shows a hinged electrical plug that can work in a similar fashion. Using this arrangement, the electrical wire can be pressed roughly flat against the wall, thereby protecting it from bending, jarring, or damage, and the prongs of the plug still insert into the socket in the normal fashion. No alteration to the socket itself is required.

An additional problem with plugging telephone cables or other cables directly into a wall jack is that only a single plug can be inserted into each jack at once. The one-plug-one-jack problem for common telephone plugs has been solved by the use of a splitter or "duplex" or "T-connector" attachment. FIG. 3 shows a commonly commercially available splitter, which has two RJ-11 jacks 46 side-by-side in a single housing 48. On the opposite side of the splitter is a single RJ-11 plug 50. This plug 50 is shown on the figure, opposite the jacks 46. The angle between the plug and jacks is essentially one-hundred-eighty degrees; that is, the plug and jacks are in a line so that they would be perpendicular to a wall when plugged into a wall jack.

More than one plug can be inserted into the splitter, into standard size jacks in a housing. These jacks are connected electrically to a single, standard sized plug, which protrudes from the housing on the opposite side, in a line away from the jacks. This single plug is then plugged into the wall outlet's jack. The signals from the wall outlet are "split" between the jacks, such that all jacks share the same signal. This type of splitter is commonly commercially available and in wide use to connect two telephone plugs into one jack. An analogous splitter is commonly commercially used for electrical plugs as well. There are available splitters for electrical outlets, allowing more than one plug to be used per wall socket.

Solutions to these problems have not been incorporated into a single apparatus, nor has the damage problem been solved for telephone or similar plugs and cables.

The following represents a list of known related art:

U.S. Pat. No. 4,857,013, issued to Peters, Aug. 15, 1989;

U.S. Design Pat. D375,291, issued to Cheung, Nov. 5, 1996.

The teachings of each of the above-listed citations (which does not itself incorporate essential material by reference) are herein incorporated by reference. None of the above inventions and patents, taken either singularly or in combination, is seen to describe the instant invention as claimed.

While the foregoing body of art indicates it to be well known to have a, the art described above does not teach or suggest a cable plug connector which has the following combination of desirable features, including: (1) it allows for the telephone plug and attached cable to be installed into a wall jack at an angle such that it is not perpendicular to the wall, and can lie flat or almost flat against the wall; (2) protects the cable and plug from jarring and damage from being hit by objects; (3) makes connection and disconnection of cables into wall jacks behind large objects, such as furniture, easier; (4) allows furniture and other large objects to be placed closer to walls; and (5) allows more than one cable to be connected to a wall jack.

SUMMARY AND ADVANTAGES

The cable plug connector of the present invention provides apparatuses and methods to connect one or more standard telephone or computer cable plugs into wall outlets of the same type at an angle, so that the devices' plugs and cables are protected from damage. Cable plug connector includes a housing, a cable plug adapter to be connected to a wall socket, attached to the housing at an angle, and a cable jack in said housing, the cable jack being electrically connected to the cable plug adapter. A method for protecting multiple cable plugs from damage, includes steps for inserting a plurality of cable plugs into a housing containing multiple cable jacks arranged side-by-side, orienting said housing such that it is perpendicular to, and attached to, a single cable plug adapter, and electrically connecting said cable jacks to said cable plug adapter.

The apparatuses and methods of the present invention present numerous advantages, including: (1) it allows for the telephone plug and attached cable to be installed into a wall jack at an angle such that it is not perpendicular to the wall, and can lie flat or almost flat against the wall; (2) protects the cable and plug from jarring and damage from being hit by objects; (3) makes connection and disconnection of cables into wall jacks behind large objects, such as furniture, easier; (4) allows furniture and other large objects to be placed closer to walls; and (5) allows more than one cable to be connected to a wall jack.

The cable plug connector of the present invention includes one or more standard jacks in a row, electrically connected to a single, standard cable plug adapter at angle. The single cable plug adapter inserts into a wall jack. The housing containing one or more jacks is attached physically to the single, standard cable plug adapter at an angle of approximately ninety degrees. Cable plugs for devices, such as phones or modems, are plugged into the apparatus and the apparatus is then plugged into a standard wall jack. This angle between the apparatus' cable plug adapter and the apparatus' jack housing allows other plugs to be inserted roughly parallel with respect to the wall, rather than being plugged directly into the wall jack, perpendicular to the wall.

With the plugs and cables roughly parallel to the wall, the plugs and attached cables are less likely to be damaged by furniture or other items pushed near to the wall.

In its preferred embodiment, the housing for the jack or jacks is mechanically connected by a hinge to a housing for the cable plug adapter, such that there is a moveable angle between the housing and the cable plug adapter. Because the connection between the housing and the cable plug adapter is hinged, the angle between the housing and the cable plug adapter can be altered as needed by the user.

Further, the cable plug connector of the present invention can be made using commonly available materials, currently used in this area of art and relatively inexpensive. The construction can be inexpensive and the invention, when mass-produced, should be inexpensive.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

FIG. 10 shows another embodiment of the invented apparatus

FIG. 11 shows another embodiment of the invented apparatus. .

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

The first embodiment of the invention is made up of one or more standard jacks in a housing, positioned side-by-side. A plug, which will be inserted into a wall socket of the same type, is attached to the exterior of the housing. The jack or jacks in the housing are electrically wired to the plug, such that any electrical signals transmitted to the plug are transferred to the jacks and vice versa. The plug is physically positioned such that it is at an approximately ninety-degree angle with respect to the jacks and their housing.

Figure 4:
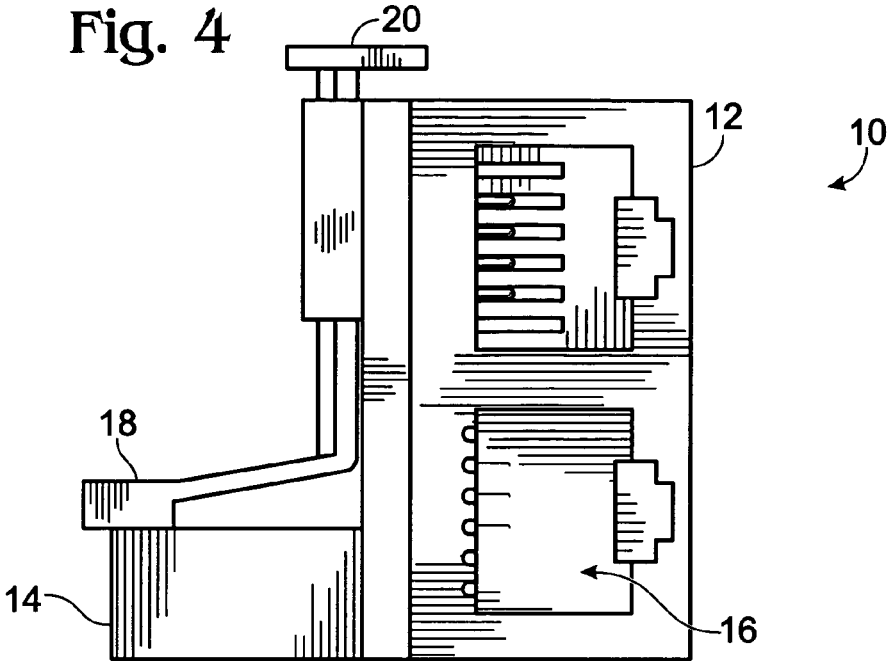
FIG. 4 shows the invented apparatus.
Figure 5:
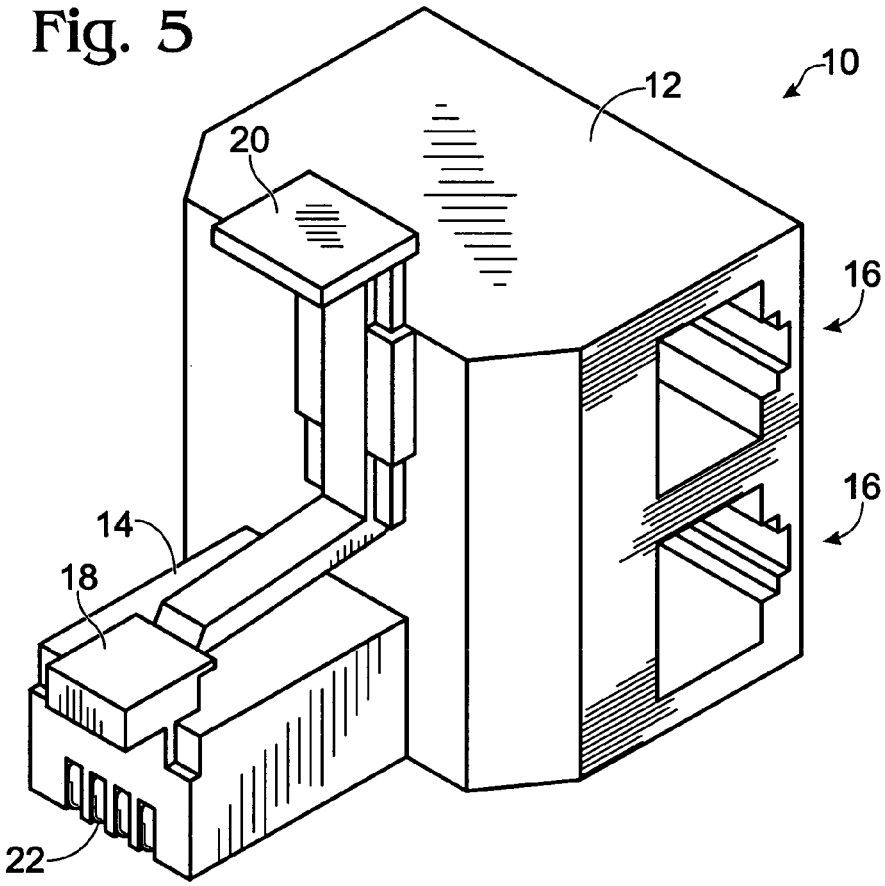
FIG. 5 shows the invented apparatus from a different angle than FIG. 4.

As shown in FIGS. 4 and 5, a cable plug connector 10 is provided to connect to one or more standard telephone or computer cable plugs into wall outlets of the same type at an angle, so that the devices' plugs and cables are protected from damage. Cable plug connector 10 comprises a housing 12, a cable plug adapter 14 to be connected to a wall socket attached to the housing at an angle, and at least one cable jack 16 in said housing, the cable jack being electrically connected to the cable plug.

FIG. 4 shows the present cable plug connector 10 from the side where the openings to the jacks 16 are, showing two side-by-side jacks 16 inside one housing 12. The plug adapter 14, that enters the wall, is shown projecting from the top of the housing 12. While cable plug connector is shown having two jacks, any number of jacks may be used.

Figure 1:
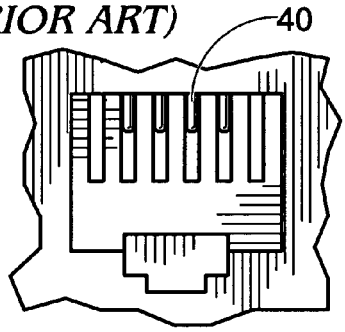
Fig. 1 (PRIOR ART)
FIG. 1 shows a head-on view of the RJ-11 telephone jack.
Figure 2:
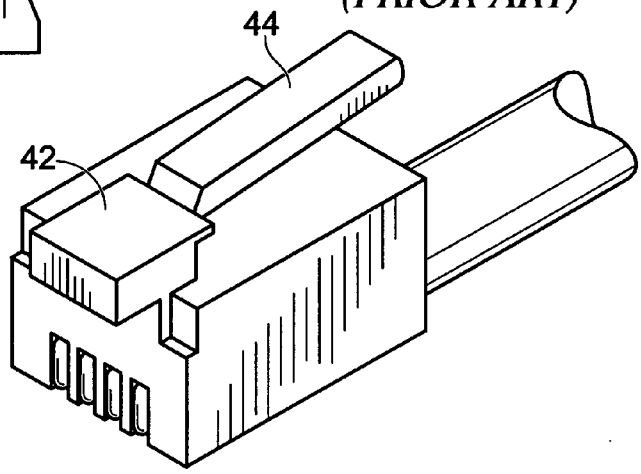
Fig. 2 (PRIOR ART)
FIG. 2 shows a view of an RJ-11 telephone plug.
Figure 3:
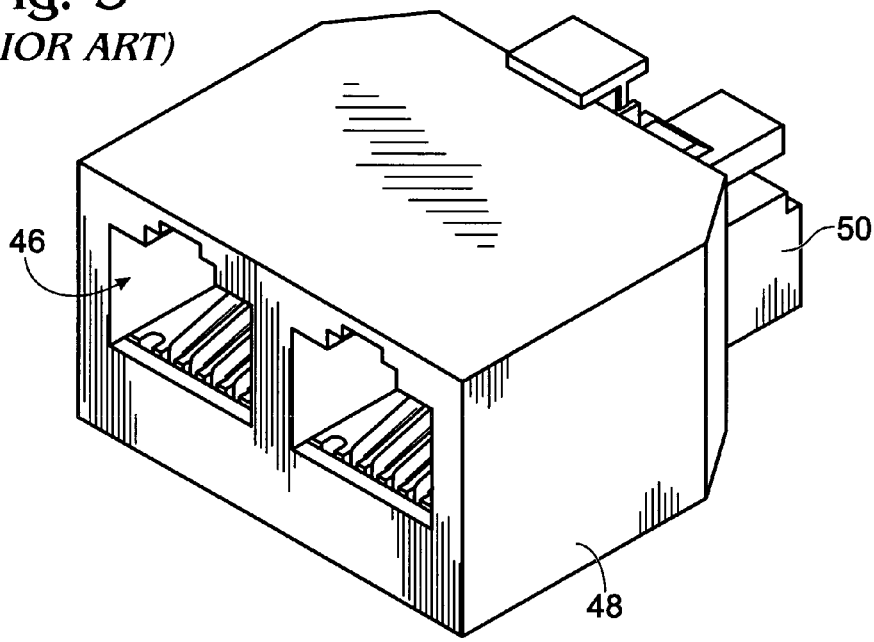
Fig. 3 (PRIOR ART)
FIG. 3 shows a commercially available RJ-11 splitter with two jacks for two RJ-11 plugs.

Like the device shown in FIG. 3, the cable plug connector 10 of FIG. 4 has a protruding clip 18 that keeps the plug adapter 14 from coming out of the wall socket. This clip is actuated by the user by pressing a tab 20 toward the housing. This tab 20 directly connects to the clip, and pressing down on the tab pushes the clip inward toward the plug adapter 14, unclipping it from the inside of the wall jack. This clipping mechanism is generally part of the use of these plugs adapters and this feature is adopted from the prior art for continuity with the existing art.

The cable plug connector in its various embodiments is wired the same as that for commercially available splitters: each of the jacks is electrically connected to the plug so that all jacks share the same electrical signals.

While cable plug connector is shown in FIG. 4 with jacks on the left side of the cable plug connector, such that telephone plugs or other device plugs used with the apparatus will come off the left side of the apparatus, cable plug connector can easily be made to have the jacks on the top, bottom, or right side of the housing. In any configuration, telephone plugs or other device plugs will be inserted parallel to a wall when the apparatus is plugged into a wall jack, rather than perpendicular to the wall.

FIG. 5 shows the cable plug connector 10 from a different angle than FIG. 4, from the cable plug adapter 14 side of the apparatus. One can see the clip 18 and tab 20, as well as the jacks 16. From this angle, one can also see the wire connectors 22 on the underside of the plug adapter 14, which will engage the matching connectors inside the wall jack.

Cable plug connector is provided with at least one jack. Connector can have a number of jacks all wired to the single plug adapter. It might be useful to have more than two jacks, so that, for example, more than one phone and a modem can be plugged into a single wall socket at once. The number of jacks is not crucial to the invention and the invention encompasses any number of jacks.

It is desirable but not essential that the jacks be side-by-side in the housing so that the housing is as flat as possible. This supports a primary improvement of the invention: to keep the attached cables as close to the wall as possible to prevent damage.

Housing in the preferred embodiment is made from plastic. Other suitable materials can be used and are well known to those skilled in the art. Any material suitable for commercially available splitters would also be suitable for the present cable plug connector.

As shown in FIGS. 6–9, the preferred embodiment of the apparatus utilizes a hinge 24 between a cable plug adapter 26 and the housing for the jacks 28. The additional feature of the preferred embodiment over the first embodiments is the presence of the hinge 24. The housing for the jack or jacks 28 is mechanically connected by a hinge 24 to a cable plug adapter 26, such that there is a moveable angle between the housing 28 and the plug adapter 26. The jacks and the plug adapter remain electrically connected by internal wiring, as noted above, and not shown on the figures. Those skilled in the art will readily connect the internal wiring.

Figure 7:
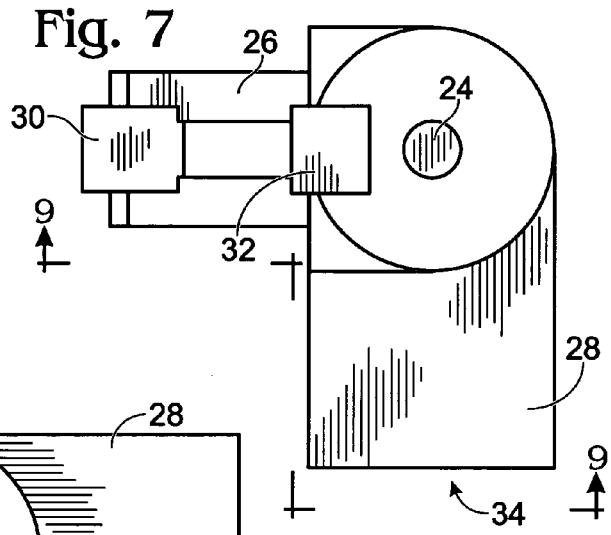
FIG. 7 shows the preferred embodiment of the invented apparatus, from the top looking downward, with the apparatus hinged at ninety degrees.
Figure 6:
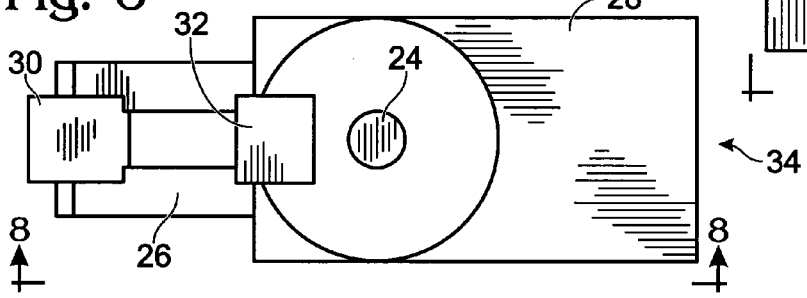
FIG. 6 shows the preferred embodiment of the invented apparatus, from the top looking downward, with the apparatus unhinged.
Figure 8:
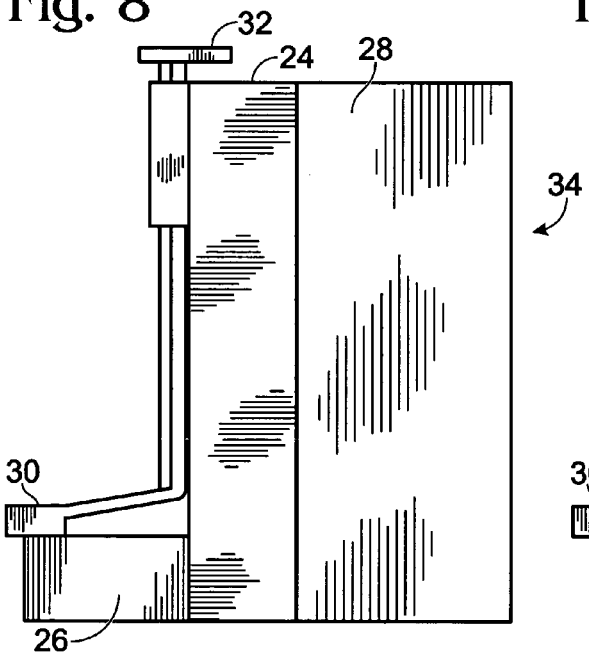
FIG. 8 shows the preferred embodiment of the invented apparatus, from the side, with the apparatus unhinged.
Figure 9:
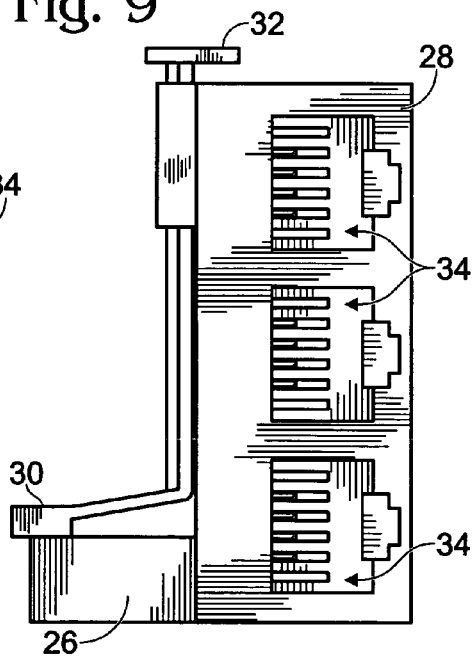
FIG. 9 shows the preferred embodiment of the invented apparatus, from the side, with the apparatus hinged at ninety degrees.

Because the connection between the two housings is hinged, the angle between the two housings can be altered as needed by the user. FIG. 7 shows the apparatus hinged such that the angle between the plug adapter 26 and the jack's housing 28 is approximately ninety degrees, while FIG. 6 shows the apparatus at a one-hundred-eighty degree angle, jacks in a line with the plug adapter. FIGS. 8 and 9 show the same thing, but from the side.

FIGS. 6–9 show the cable plug connector with three jacks. The number of jacks is not an essential aspect of the invention, and the apparatus can utilize any number of jacks. Further, similar to what was noted in the first embodiment, the housing for the jacks can be faced in different directions. Here, the jack's housing is configured such that the jacks are oriented up and down, along the wall. The apparatus could be configured such that the jacks are oriented across the wall, from right to left. This could be accomplished easily by turning the hinge with respect to the plug adapter ninety degrees so that the hinge was roughly horizontal. This way, device plugs could be inserted from the top or bottom of the apparatus.

In another embodiment, FIG. 10, cable plug connector 60 comprises a flat housing 62, one or more cable jacks in said housing 64. Cable jack in said housing can be any of standard cable jacks known to those skilled in the art, and which are purchased prewired to connect to standard telephone electrical wiring in a wall. Exemplary cable jacks include the Top Entry Metal Pegs Modular Jack, Model 3044 Series and Side Entry Modular Telephone Jack, 3001 Series, from Singatron Ent. Co., Ltd. (USA), 13925 Magnolia Avenue, Chino, Calif. 91710. In operation, flat housing attaches to wall by screws, nails, or glue, or other suitable attachment manner, the scope of which is well known to those skilled in the art. Wiring in housing connects to standard electrical wiring in the wall, the connection being readily ascertainable to electricians, telephone repairpersons and others skilled in the art. Cable plugs into cable jack.

In another embodiment FIG. 11, cable plug connector 10 of FIGS. 4 and 5, is provided with one or more tethered cable plug adapters 15, replacing the fixed cable plug adapter 14 and tab 20. The tethered cable plug adapters 15 are wired in the same fashion as the fixed cable plug adapter 14, with the wires running through the tether 15*a* and connect to the wall in the same manner, but leave maneuvering and adjustment room. The wires are covered with rubber or other suitable wire sheathing material well known to those skilled in the art.

Those skilled in the art will recognize that numerous modifications and changes may be made to the preferred embodiment without departing from the scope of the claimed invention, including, of course, various particular arrangements of the actual electronic components used or various physical placements of actual electronic components used. It will, of course, be understood that modifications of the invention, in its various aspects, will be apparent to those skilled in the art, some being apparent only after study, others being matters of routine mechanical and electronic design. No single feature, function or property of the preferred embodiment is essential, except as mentioned above. Other embodiments are possible, their specific designs depending upon the particular application. As such, the scope of the invention should not be limited by the particular embodiments herein described but should be defined only by the appended claims and equivalents thereof.

I claim:

1. An improved cable plug connector comprising:

a cable plug adapter for use in a socket in a wall;

a cable jack in a housing, said cable jack being electrically connected to said cable plug adapter;

said cable jack housing hingeably connected to said cable plug adapter, such that the angle between said cable plug adapter and said cable jack housing can hinge between 180 degrees and 90 degrees such that a cable connected to said lack can be hinged to be parallel to said wall socket.

2. The apparatus in claim 1, wherein said cable jack is made to receive a standard telephone plug and said cable plug adapter is a standard telephone plug.

3. A cable plug connector comprising:

a cable plug adapter for use in a socket in a wall;

a plurality of cable jacks in a housing, arranged side-by-side in a linear fashion, said cable jacks being electrically connected to said cable plug adapter; and said housing hingeably connected to said cable plug adapter, such that the angle between said cable plug adapter and said cable jack housing can hinge between 180 degrees and 90 degrees.

4. The apparatus in claim 3, wherein said cable jacks are made to receive a standard telephone plug and said cable plug adapter is a standard telephone plug.

* * * * *